US007159413B2

(12) United States Patent
Dail

(10) Patent No.: US 7,159,413 B2
(45) Date of Patent: Jan. 9, 2007

(54) MODULAR REFRIGERATION SYSTEM

(75) Inventor: William K. Dail, Grayson, GA (US)

(73) Assignee: Delaware Capital Formation, Inc., Wilmington, DE (US)

( * ) Notice: Subject to any disclaimer, the term of this patent is extended or adjusted under 35 U.S.C. 154(b) by 282 days.

(21) Appl. No.: 10/689,785

(22) Filed: Oct. 21, 2003

(65) Prior Publication Data

US 2005/0081551 A1 Apr. 21, 2005

(51) Int. Cl.
*F25D 19/00* (2006.01)
*F25B 39/02* (2006.01)

(52) U.S. Cl. ..... 62/298; 62/524; 62/254

(58) Field of Classification Search ..... 62/298, 62/254, 256, 524, 251, 199
See application file for complete search history.

(56) References Cited

U.S. PATENT DOCUMENTS

| | | | | |
|---|---|---|---|---|
| 1,594,653 | A | | 8/1926 | Anstey |
| 1,721,145 | A | | 7/1929 | Bromann |
| 1,896,693 | A | | 2/1933 | Battista |
| 2,136,232 | A | | 11/1938 | Bromann, Jr. |
| 2,156,795 | A | | 5/1939 | Smith |
| 2,181,637 | A | | 11/1939 | Ardito |
| 2,209,690 | A | | 7/1940 | Fraser |
| 2,225,655 | A | | 12/1940 | Ottenheimer |
| 2,382,599 | A | | 8/1945 | Blair |
| 2,425,473 | A | | 8/1947 | Hoffman |
| 2,444,593 | A | | 7/1948 | Davis |
| 2,495,327 | A | | 1/1950 | Hardin |
| 2,513,675 | A | | 7/1950 | Quillen |
| 2,663,159 | A | | 12/1953 | Ullstrand |
| 2,931,408 | A | | 4/1960 | Dwyer et al. |
| 2,962,874 | A | | 12/1960 | Fitzgerald |
| 2,973,631 | A | | 3/1961 | Adkins |
| 3,210,957 | A | * | 10/1965 | Walling et al. ..... 62/255 |
| 3,230,732 | A | | 1/1966 | Rutishauser et al. |
| 3,254,502 | A | | 6/1966 | Ellis |
| 3,850,486 | A | | 11/1974 | Saxe |
| 3,898,864 | A | | 8/1975 | Steelman |
| 4,135,369 | A | | 1/1979 | Allgeyer et al. |
| 4,151,723 | A | | 5/1979 | Gardner |
| 4,306,616 | A | | 12/1981 | Woods, Jr. et al. |
| 4,344,296 | A | * | 8/1982 | Staples et al. ..... 62/175 |
| 4,369,631 | A | | 1/1983 | Abraham |
| 4,489,995 | A | | 12/1984 | Barr |
| 4,493,010 | A | * | 1/1985 | Morrison et al. ..... 361/698 |

(Continued)

FOREIGN PATENT DOCUMENTS

| | | |
|---|---|---|
| DE | 25 05 390 A1 | 8/1976 |

(Continued)

*Primary Examiner*—Chen Wen Jiang
(74) *Attorney, Agent, or Firm*—Foley & Lardner LLP

(57) ABSTRACT

A modular refrigeration system includes a refrigeration device having a space configured for storage of products therein, a cooling system providing a coolant configured to cool the space, and at least one modular cooling element configured for placement at any one of a plurality of locations within the space and configured to receive the coolant so that a temperature distribution profile of the products within the space can be customized. A method of customizing a temperature distribution profile within a refrigeration device having a cooling system is also disclosed. The method includes the steps of determining a temperature distribution profile within the refrigeration device, identifying at least one location within the refrigeration device having a temperature above a desired temperature range, providing a modular cooling element configured for installation at the location, and interconnecting the modular cooling element with the cooling system.

41 Claims, 5 Drawing Sheets

U.S. PATENT DOCUMENTS

| | | | | |
|---|---|---|---|---|
| 4,501,126 | A * | 2/1985 | Norton | 62/185 |
| 4,712,387 | A | 12/1987 | James et al. | |
| 4,984,435 | A | 1/1991 | Seino et al. | |
| 5,148,861 | A | 9/1992 | Colvin et al. | |
| 5,277,486 | A | 1/1994 | Bustos | |
| 5,347,827 | A | 9/1994 | Rudick et al. | |
| 5,357,767 | A | 10/1994 | Roberts | |
| 5,365,749 | A | 11/1994 | Porter | |
| 5,381,670 | A | 1/1995 | Tippmann et al. | |
| 5,440,894 | A * | 8/1995 | Schaeffer et al. | 62/203 |
| 5,502,979 | A | 4/1996 | Renard | |
| 5,606,863 | A | 3/1997 | Kicklighter et al. | |
| 5,626,028 | A | 5/1997 | Graat et al. | |
| 5,675,983 | A | 10/1997 | Ibrahim | |
| 5,735,131 | A | 4/1998 | Lambright, Jr. et al. | |
| 5,743,098 | A | 4/1998 | Behr | |
| 5,816,051 | A | 10/1998 | Hall et al. | |
| 5,921,096 | A | 7/1999 | Warren | |
| 5,924,297 | A | 7/1999 | Wolff et al. | |
| 5,931,018 | A | 8/1999 | Hall et al. | |
| 5,964,512 | A | 10/1999 | Borgen | |
| 5,970,734 | A | 10/1999 | Stillwell et al. | |
| 6,073,452 | A | 6/2000 | Karp et al. | |
| 6,128,911 | A | 10/2000 | Mathews et al. | |
| RE37,054 | E | 2/2001 | Sherwood | |
| 6,182,459 | B1 | 2/2001 | Hertel | |
| 6,185,951 | B1 | 2/2001 | Lane et al. | |
| 6,311,512 | B1 | 11/2001 | Fung et al. | |
| 6,351,964 | B1 | 3/2002 | Brancheau et al. | |
| 6,360,548 | B1 | 3/2002 | Navarro | |
| 6,381,972 | B1 | 5/2002 | Cotter | |
| 6,401,399 | B1 | 6/2002 | Roche et al. | |
| 6,401,477 | B1 | 6/2002 | Dubé | |
| 6,412,296 | B1 | 7/2002 | Rossi | |
| 6,427,468 | B1 | 8/2002 | Topper et al. | |
| 6,438,983 | B1 | 8/2002 | Zellner et al. | |
| 6,460,372 | B1 | 10/2002 | Fung et al. | |
| 6,467,294 | B1 | 10/2002 | Walker et al. | |
| 6,499,535 | B1 | 12/2002 | Cowans | |
| 6,539,741 | B1 | 4/2003 | Navarro | |
| 6,547,346 | B1 | 4/2003 | Topper et al. | |
| 6,619,052 | B1 | 9/2003 | Nash, Jr. | |
| 6,672,086 | B1 | 1/2004 | Zangari et al. | |
| 2002/0066549 | A1 | 6/2002 | Schulz et al. | |
| 2002/0184904 | A1 | 12/2002 | Wellman | |
| 2003/0230095 | A1 | 12/2003 | Kahler | |
| 2005/0126196 | A1 | 6/2005 | Grassmuck et al. | |

FOREIGN PATENT DOCUMENTS

| | | | |
|---|---|---|---|
| EP | 0 701 097 | B1 | 3/1996 |
| EP | 0 916 291 | B1 | 5/1999 |
| GB | 2 185 561 | A | 7/1987 |
| JP | 2000-274935 | A | 10/2000 |

* cited by examiner

MODULAR REFRIGERATION SYSTEM

FIELD OF THE INVENTION

The present invention relates to a refrigeration system. The present invention more particularly relates to a modular refrigeration system of a type including a modular cooling element. The present invention also more particularly relates to a modular refrigeration system in the form of a temperature controlled case for products (such as foodstuffs) including one or more modular cooling elements for customizing a temperature distribution profile within the case.

BACKGROUND

It is well known to provide a refrigeration system including a refrigeration device such as a refrigerated case, refrigerator, freezer, etc., often referred to as a temperature controlled case for use in commercial and industrial applications involving the storage and/or display of objects, products and materials. For example, it is known to provide a refrigeration system with one or more temperature controlled cases for display and storage of frozen or refrigerated foods in a supermarket to maintain the foods at a suitable temperature (e.g. 32 to 35 deg F.). In such applications, such refrigeration systems often are expected to maintain the temperature of a space within the temperature controlled case where the products are contained within a particular range that is suitable for the particular products, typically well below the room or ambient air temperature within the supermarket. Such known refrigeration systems will typically include a heat exchanger in the form of an evaporator or main heat exchanger fixedly or permanently installed within the refrigeration device and configured to provide a flow of a coolant such as a liquid secondary coolant or a direct expansion refrigerant into the cooling element to refrigerate (i.e. remove heat from) the space within the temperature controlled case. The heat exchangers typically provide cooling by "natural" convention (e.g. "gravity coils," etc.) or by forced convention (e.g. "fan-coils," etc.). The heat exchangers are usually provided in fixed locations within the temperature controlled case. For example, gravity coils may be provided in an upper location within the case, while fan-coils may be located within a duct or flue provided above, beneath, or behind the case. Various known configurations of refrigeration systems (e.g. direct expansion refrigerant system and/or liquid secondary coolant system, etc.) are used to provide cooling to the heat exchangers (e.g. by supply of coolant).

It is also well known that use of such fixedly or permanently installed heat exchangers provided at such generally fixed locations tends to result in a variation of the temperature of the products within the temperature controlled case, depending on the proximity of the products to certain thermal influences that tend to increase temperature (such as walls, doors, windows, lighting equipment, etc.) or that tend to decrease temperature (such as beneath gravity coils, adjacent to forced-air discharge devices, etc.). The variation in temperature of the products tends to result in certain products not being maintained at a desired temperature (e.g. either too warm or too cold). Typical control systems or settings for such temperature controlled cases tend to compensate for the variation in temperature of the products by reducing the temperature setting for the case so that the temperature of the "warmest" products is sufficiently reduced and maintained within a desired temperature range. However, such compensating measures tend to result in certain disadvantages, such as increased energy consumption, an increased frequency required for defrosting the cooling elements, "overcooling" of products located in other areas of the case, etc.

Accordingly, it would be advantageous to provide a refrigeration system of a type configured to provide a more uniform temperature distribution within a temperature controlled case. It would also be advantageous to provide for a refrigeration system that provides flexibility for customizing a temperature distribution profile within various types of temperature controlled cases. It would further be advantageous to provide a refrigeration system that provides modular cooling elements that may be positioned to supplement the heat exchangers of a temperature controlled case. It would be further advantageous to provide a refrigeration system with modular cooling elements that are positionable for customizing or tailoring thermal performance in a temperature controlled case. It would further be advantageous to provide a refrigeration system with modular cooling elements that are reconfigurable for adapting to changes in product loading, product combinations or changes in an operating environment for the temperature controlled case. It would be further advantageous to provide a refrigeration system that may be adapted for use with existing temperature controlled cases to provide a more uniform temperature distribution profile for products stored and displayed within the case and to provide improved thermal performance within the case.

Accordingly, it would be advantageous to provide a refrigeration system with a modular cooling element having any one or more of these or other advantageous features.

SUMMARY

The present invention relates to a modular refrigeration system including a refrigeration device having a space configured for storage of products therein, a cooling system providing a coolant configured to cool the space, and at least one modular cooling element configured for placement at any location within the space and configured to receive the coolant so that a temperature distribution profile of the products within the space can be customized.

The present invention also relates to a system for customizing a temperature distribution profile within a space of a refrigeration device and includes a cooling system having a first heat exchanger in a substantially fixed location and a coolant configured to cool the space, a second heat exchanger configured for selective placement at a desired location within the refrigeration device, a piping system configured to interface with the cooling system and the second heat exchanger to provide a supply of coolant to the second heat exchanger, and a control system configured to regulate a flow of coolant through the second heat exchanger.

The present invention further relates to a temperature controlled case having a modular cooling system and includes a cooling system providing a coolant and having a main cooling element in a substantially fixed location and configured to receive the coolant and provide cooling to a space within the temperature controlled case, at least one supplemental cooling element configured to interface with the cooling system and to receive a supply of the coolant, where the supplemental cooling element is configured to be selectively mounted at any location within the space so that a variation of a temperature range within the space can be substantially minimized.

The present invention further relates to a method of customizing a temperature distribution profile within a refrigeration device having a cooling system and includes the steps of determining a temperature distribution profile within the refrigeration device provided by the cooling system, identifying at least one location within the refrigeration device having a temperature above a desired temperature range, providing a modular cooling element configured for installation at the location, and interconnecting the modular cooling element with the cooling system.

DETAILED DESCRIPTION

Figure 1:
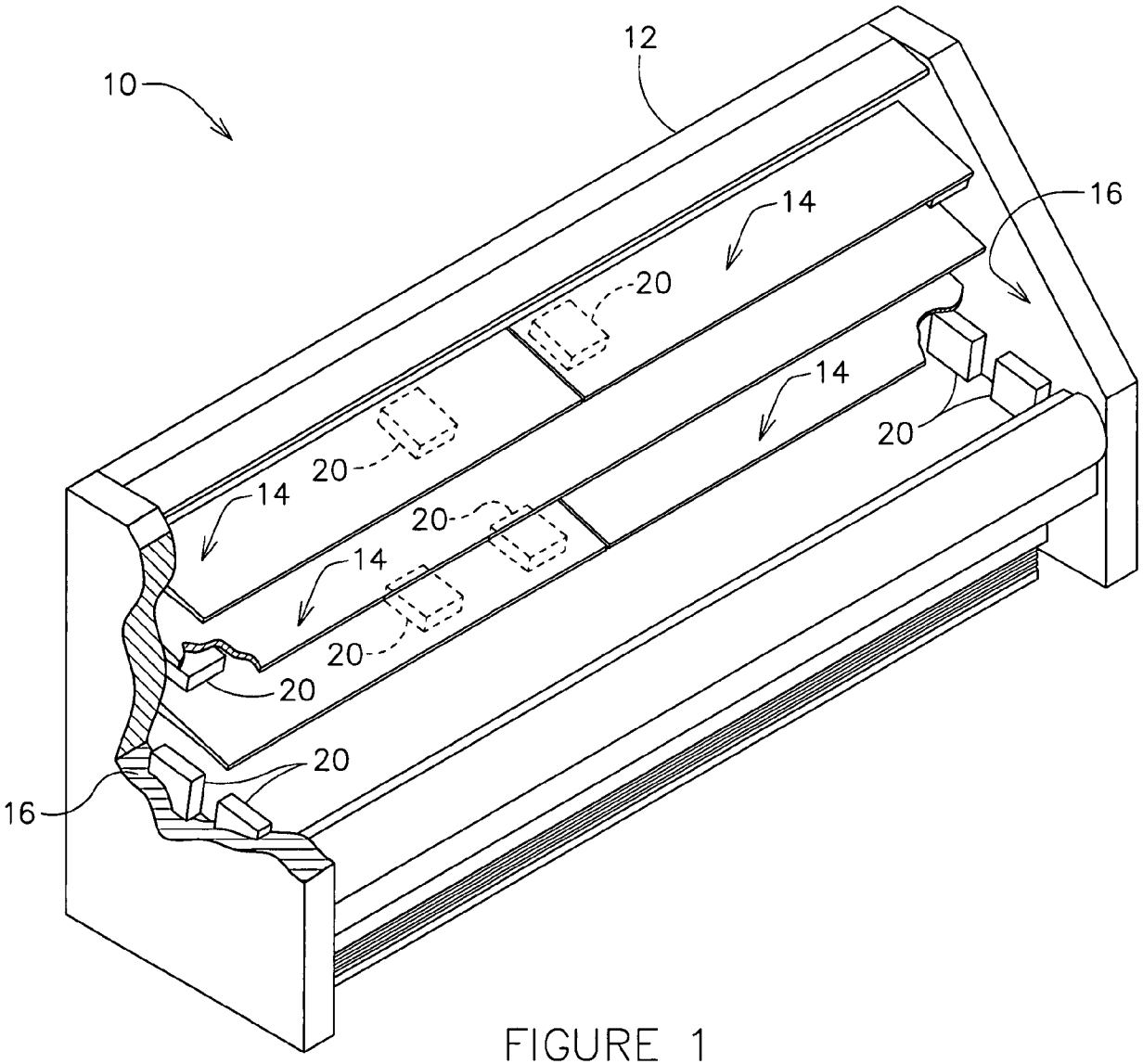
FIG. 1 is a schematic diagram of a front perspective view of a modular refrigeration system according to an exemplary embodiment.

Referring to FIG. 1, a modular refrigeration system 10 is shown according to an exemplary embodiment. The modular refrigeration system is shown schematically and described for use with a refrigeration device shown as a temperature controlled case of a type having an open front, vertically-oriented shelves, and a forced-air cooling system. However, according to other exemplary embodiments, the modular refrigeration system may be provided with any of a wide variety of other types of refrigeration devices. For example, the modular refrigeration system may be used with temperature controlled cases having a closed front with doors or other access openings provided in the rear of the case and a gravity type cooling coil therein, or with cases of a type having doors on the front for direct access to the products by consumers, or with cases having an open top and a "well" for storage of products, or with cases designed to provide for a "low" temperature (e.g. frozen) storage and display of products or for a "medium" temperature (e.g. chilled, refrigerated, etc.) storage and display of products. Accordingly, the description of the embodiments provided herein is illustrative and is intended for use with any of a wide variety of temperature controlled cases for both new construction and existing or retro-fit applications.

Referring to the FIGURES, refrigeration system 10 is shown according to an exemplary embodiment and includes a temperature controlled case 12, a cooling system 50, 150, 250, 350 for cooling and circulating a coolant within the case 12, modular cooling elements 20 (e.g. heat exchanger, supplemental cooling element, portable cooling element, etc.), and a piping system 30, 130, 230, 330 (as shown in FIGS. 4–7) for circulating a coolant (e.g. a "primary coolant" such as a volatile or direct expansion refrigerant, a "secondary coolant" such as a liquid secondary coolant configured to be chilled by a primary coolant, etc.), and a control system 70 for controlling the operation of the case 12. The temperature controlled case 12 includes product storage surfaces (shown schematically as including shelves 14) for storing and displaying products (such as foodstuffs) within the case 12 at a desired temperature (e.g. within a range of 32–35 degrees F., etc.) for maintaining the freshness, "shelf life," appearance and longevity of the products.

The cooling system may include components of a type generally found in conventional type cooling systems known for use with temperature controlled cases (such as, for example, a compressor, a condenser, a receiver, an expansion device, a heat exchanger such as an evaporator, pumps, chillers, and a fan located within a portion of the case for circulating a flow of air over the evaporator for distribution within the case for cooling products). According to other embodiments, the cooling system may include a gravity-type cooling element such as a "gravity coil" positioned near a top of the interior space of the case for receiving a flow of coolant and for cooling air within the space through a "natural" convection air circulation pattern.

Typical cases that are generally known within the temperature controlled case industry and having such conventional type cooling systems tend to provide a variation of thermal performance within the case that results in variation of the temperature of the products due to factors such as location of the products within the case and proximity to "cooling influences" such as the cooled air discharge devices and flow paths, and the cooling elements, or proximity of the products to "warming influences" such as openings, doors, lighting elements, side or end panels of the case, etc. The variation in temperature of the products resulting from certain products being in or adjacent to "warm spots" typically requires that certain components of the cooling system of the case (e.g. evaporator, cooling coils, etc.) be operated at a "lower" temperature in order to "draw down" the temperature of the warm spots so that the products are maintained at the desired temperature. Such practices are believed to result in "overcooling" certain products located near the cooling influences, and to result in reduced efficiency, increased power consumption and an increased frequency or duration for defrosting cycles for the cooling system components.

Figure 2:
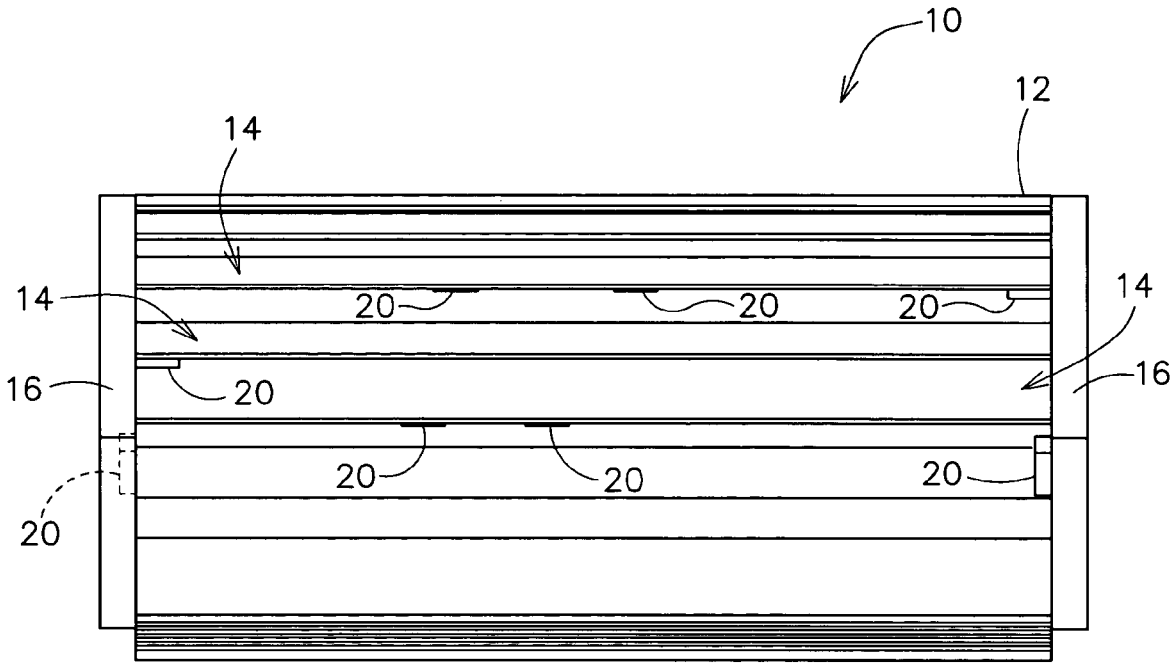
FIG. 2 is a schematic diagram of a front view of a modular refrigeration system according to an exemplary embodiment.
Figure 3:
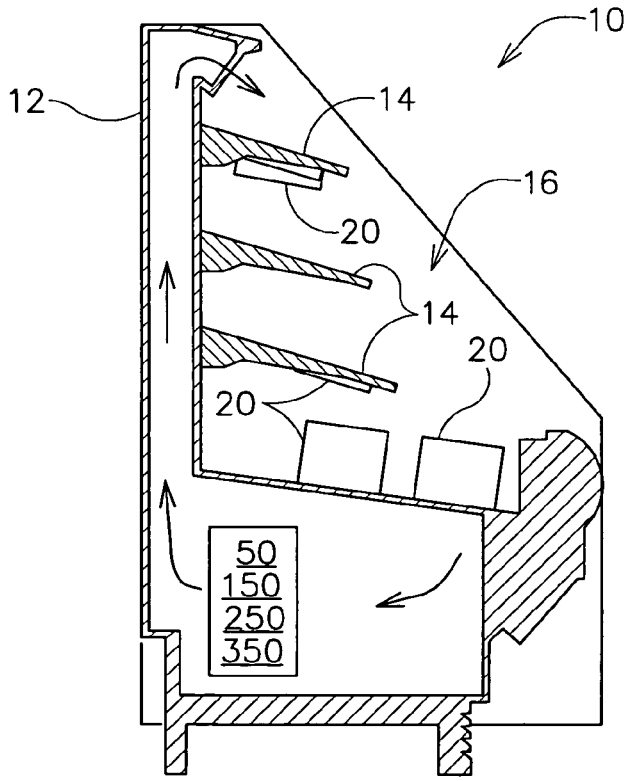
FIG. 3 is a schematic diagram of a cross sectional view of a modular refrigeration system according to an exemplary embodiment.

According to any exemplary embodiment, the modular cooling elements 20 are intended to permit customizing or normalizing the thermal performance within the case 12 to provide a desired (e.g. more uniform, etc.) temperature profile of the products within the case 12. The modular cooling elements 20 are configured for placement at any suitable location within the case 12. For example, modular cooling elements 20 may be located at any one or more of the following locations. The module cooling elements 20 may be provided beneath or within shelves 14 configured for placement of the products thereon (as shown schematically in FIGS. 1 through 3). The modular cooling elements 20 may be provided at junctions between sections of the shelves 14 (as shown schematically in FIG. 1). The modular cooling elements 20 may be provided at "sides" or "ends" of the case and may be mounted on a surface (e.g. shown schematically as a wall 16, etc.) facing an interior of the case 12 or may be mounted within a wall 16 (as shown schematically in FIG. 1). According to any preferred embodiment the modular cooling elements 20 may be provided at any suitable location within the case 12 (e.g. deck pans, end panels, product stops, flues, etc.) to enhance the thermal performance of the case and to provide a more uniform temperature distribution profile of the products within the case.

According to one exemplary embodiment, the location of the modular cooling elements can be established during initial design, prototyping or construction of "new" cases, for example, by experimentation and monitoring the temperature of actual or "simulated" products at various locations within the case for use with various types of products (e.g. meat, poultry, fish, dairy products, precooked meals, produce, chilled beverages, etc.) to determine the temperature profile characteristics within the case. Determination of the temperature profile characteristics within the case permits positioning a modular cooling element having a suitable size and shape at a strategic location to provide a desired temperature for the products. According to another exemplary embodiment, the modular cooling elements may be installed at suitable locations within an "existing" case that is "in-service" in a facility such as a supermarket, etc. (e.g. as a retrofit, upgrade, enhancement, modification, etc.).

The modular cooling elements 20 may be configured in any suitable shape and size for use in providing cooling at a "localized" portion of the case 12. According to an exemplary embodiment, the modular cooling elements 20 are configured as generally "planar" elements having a relatively "low profile" to remain relatively unobtrusive or to "fit" within walls 16, shelves 14 or other components within the case 12, and adapted to fit along or within any suitable surface (shelf, wall, end panel, etc.) within the case 12. The modular cooling elements 20 are adapted to receive a flow of a coolant therethrough to provide cooling at the locations where the modular cooling elements are installed.

The modular cooling elements may be provided as a "coil" or other suitable pattern of tubing and may include "fins" or other suitable structure for enhancing the cooling effect within the case. The modular cooling elements may also be provided as "plate" type heat exchangers, or "micro-channel" type heat exchangers or may be provided as flat panels (e.g. pans, etc.) having a pattern of passages formed therein for circulating a coolant therethrough. The size and capacity of the modular cooling elements may be varied to provide the desired amount of cooling at a particular location. Coupling of the modular cooling elements to other components within the case may be accomplished by any suitable method, such as conventional fasteners, adhesives, placement within suitably sized recesses, encapsulation within walls, shelves, panels or other components within the case. The modular cooling elements may be provided with an appearance, trim or "finish" intended to improve the aesthetics and compatibility of the modular cooling elements with the appearance of the case, such as by "matching" materials or colors (e.g. coated with epoxy or other suitable material, stainless steel, painted, wood-grain finish, etc.).

According to an alternative embodiment, the modular cooling elements may have any other suitable shape. For example, the modular cooling elements may be "angled" or "bent" for use in corners or other junctions of components within the case, or may be "curved" to conform or "fit" specific contours within the case. Accordingly, the modular cooling elements may have any suitable shape adapted to fit conveniently within any suitable location within the case.

According to any exemplary embodiment, the modular cooling elements 20 are provided in any suitable shape and size to "fit" a desired location within the case. The modular cooling elements 20 are intended to "supplement" the cooling provided within the case 12 by the cooling system and can be removed or reconfigured (e.g. portable, interchangeable, etc.) within the case 12 to adapt to changes in the thermal performance characteristics of the case. The modular cooling elements 20 are intended to permit "customizing" or "tailoring" the thermal performance of a particular type of case or case geometry, and for use with particular products or combinations of products within a case. The flexibility provided by the capability to provide modular cooling elements at certain "localized" locations within the case is intended to improve the thermal performance of the case and to provide a desired (e.g. more uniform or normalized) temperature distribution of products within the case. It is believed that establishing a more uniform temperature profile within the case tends to minimize the need for the existing practice of reducing the overall temperature of the case to compensate for "warm" spots. The ability to compensate for "warm" spots without reducing the overall temperature within the case is intended to permit "floating" or "raising" the temperature of the case provided by the cooling system "upward" by a certain amount and is believed to enhance the longevity of products stored and displayed within the case. The ability to raise the overall operating temperature for certain cases is also believed to reduce the frequency and/or duration at which defrosting of the evaporator, gravity coil or other cooling elements within the case is required, and is also believed to improve the efficiency of the case and to reduce the overall energy consumption required for operation of the case. In particular, the ability to reduce defrosting frequency and/or duration tends to reduce the required cooling load by minimizing the addition of heat to the case and to reduce energy consumption (such as for cases operated with electric defrosting elements). The ability to "float" or raise the overall case temperature upward is believed to further reduce the energy consumption of the case and to improve overall efficiency.

The piping system is intended to provide a flow of coolant from a coolant supply source to the modular cooling elements. The coolant supply source may be a separate coolant supply source (not shown), or may be provided by the cooling system for the case. According to an exemplary embodiment, the coolant supply source is the cooling system for the case and the piping system circulates a coolant between the cooling system and the modular cooling element(s). The piping system includes suitable conduits (e.g. piping, tubing, hoses, etc.) for providing a supply and return flow path between the cooling system and the modular cooling element(s). Suitable connecting devices (e.g. quick-disconnects, couplings, unions, etc.) are provided with the piping system for interfacing or interconnecting the piping system with the cooling system and the modular cooling device(s). The piping system also includes suitable flow regulating devices (e.g. any one or more of orifices, valves such as solenoid valves, balance valves, on-off devices, flow regulating valves, pressure regulating valves, and expansion devices).

Figure 4:
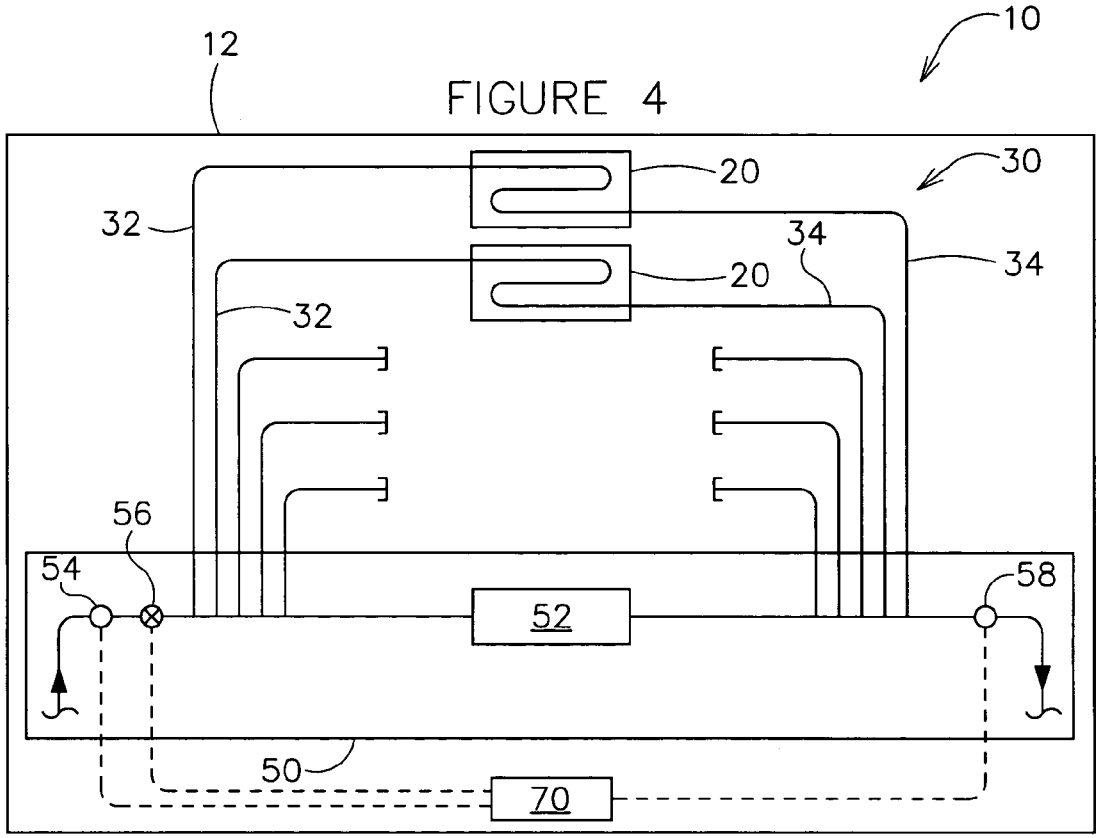
FIG. 4 is a schematic diagram of a piping system for a modular refrigeration system according to an exemplary embodiment.

Referring to FIG. 4, a piping system 30 for use with modular cooling elements 20 (shown schematically as two modular cooling elements) and a direct-expansion refrigerant type cooling system 50 for a case 12 is shown according to an exemplary embodiment. Piping system 30 includes branch supply lines 32 (shown schematically as two branch supply lines) connected to an "upstream" side of an evaporator 52 of the cooling system 50 and routed to modular cooling elements 20, and branch return lines 34 (shown schematically as two branch return lines) interconnecting the modular cooling elements 20 and a "downstream" side of the evaporator 52. The cooling system 50 includes a control valve 54 (such as a liquid solenoid valve, on-off device, etc.) and an expansion device 56 (such as an electronic or thermostatic expansion valve, etc.) for providing the refrigerant to the modular cooling elements 20. A control valve 58 (such as a solenoid valve, pressure regulating valve, etc.) is provided on the cooling system 50 "downstream" of the branch return lines 34 to control, balance or regulate the flow of the refrigerant through the modular cooling elements 20. According to an alternative embodiment, any suitable number of branch supply and return lines may be provided to circulate the refrigerant to any number of modular cooling elements provided within the case, or to accommodate the addition of other modular cooling elements at a future time (e.g. when product type or loading conditions within the case are changed or modified, etc.).

Figure 5:
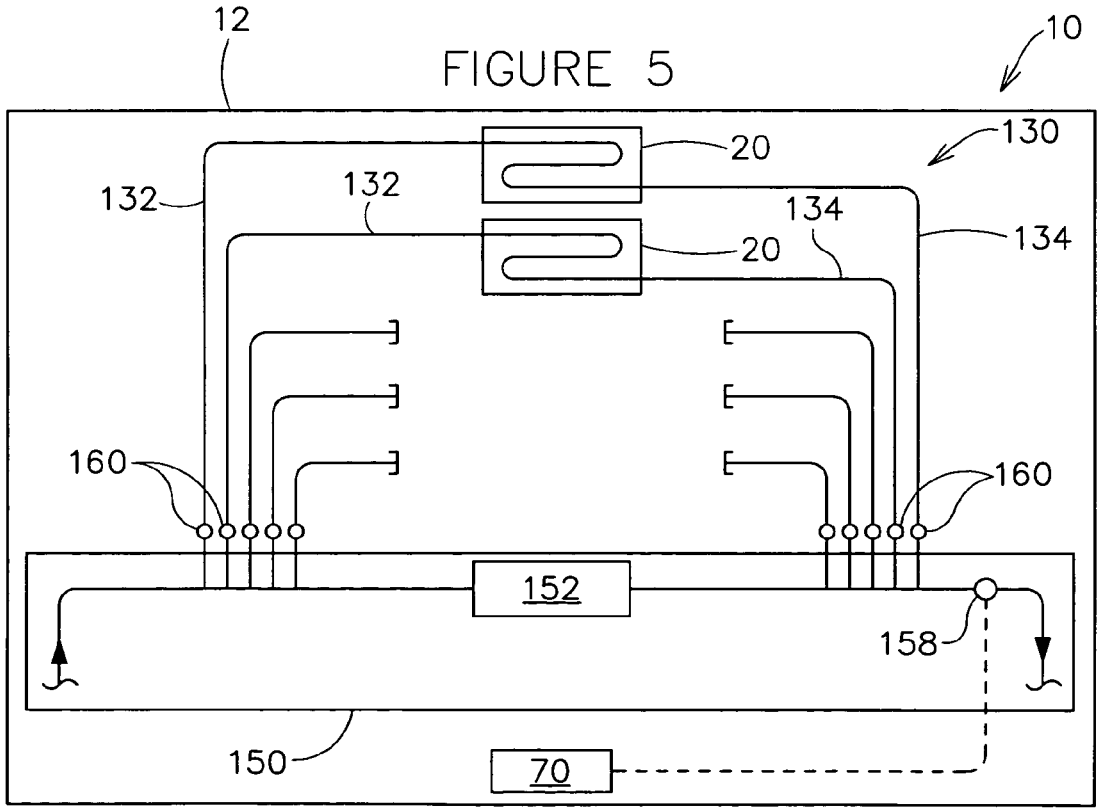
FIG. 5 is a schematic diagram of a piping system for a modular refrigeration system according to another exemplary embodiment.

Referring to FIG. 5, a piping system 130 for use with modular cooling elements 20 (shown schematically as two modular cooling elements) and a liquid secondary coolant type cooling system 150 for a case 12 is shown according to an exemplary embodiment. Piping system 130 includes branch supply lines 132 (shown schematically as two branch supply lines) connected to an "upstream" side of a main heat exchanger 152 of the cooling system 150 and routed to modular cooling elements 20, and includes branch return lines 134 (shown schematically as two branch return lines) interconnecting the modular cooling elements 20 and a "downstream" side of the main heat exchanger 152. The piping system 130 includes connection devices 160 (e.g. quick disconnect, etc.) for coupling the branch supply lines 132 and the branch return lines 134 to the cooling system 150. A control valve 158 (such as a solenoid valve, on-off device or flow regulating device or valve, etc.) is provided on the cooling system 150 "downstream" of the branch return lines 134 to control, balance or regulate the flow of the secondary coolant through the modular cooling elements 20. According to an alternative embodiment, any suitable number of branch supply and return lines may be provided to circulate a secondary coolant to any number of modular cooling elements provided within the case, or to accommodate the addition of other modular cooling elements at a future time (e.g. when product type or loading conditions within the case are changed or modified, etc.).

Figure 6:
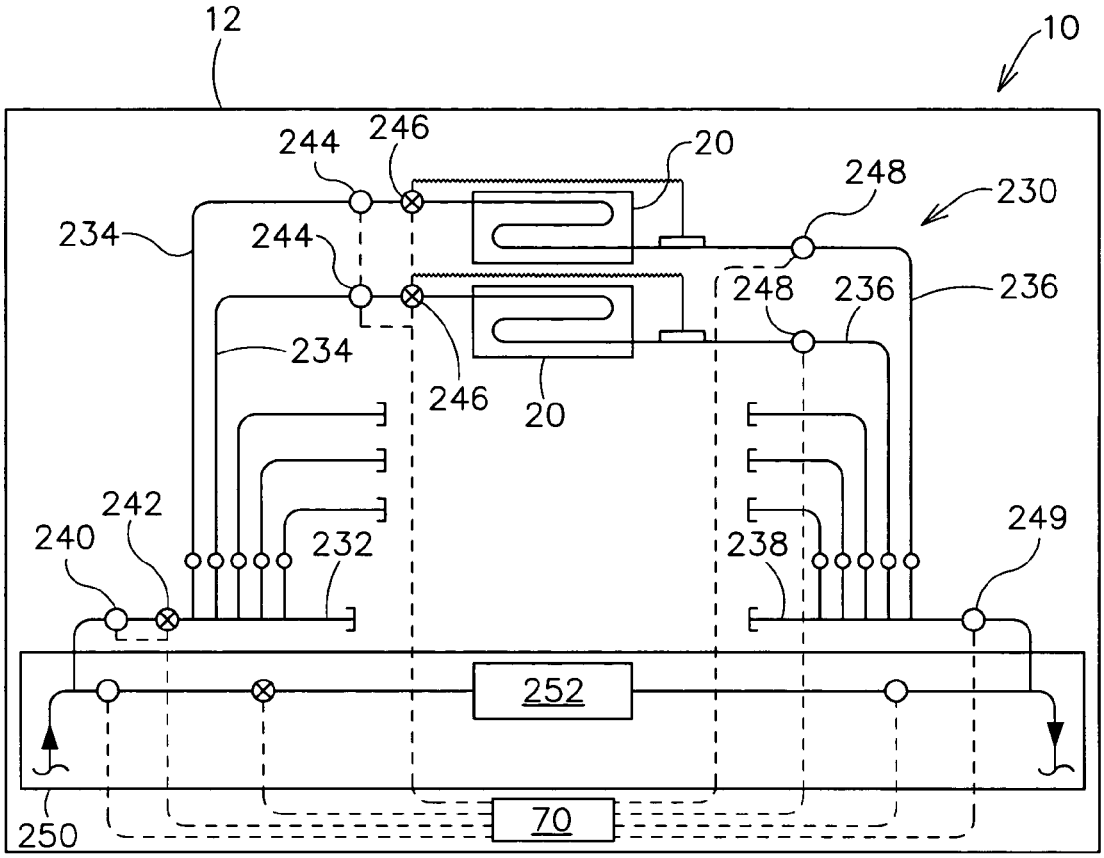
FIG. 6 is a schematic diagram of a piping system for a modular refrigeration system according to a further exemplary embodiment.

Referring to FIG. 6, a piping system 230 for use with independent control of modular cooling elements 20 (shown schematically as two modular cooling elements) and a direct-expansion refrigerant type cooling system 250 for a case 12 is shown according to an exemplary embodiment. Piping system 230 includes a branch supply header 232 and branch supply lines 234 (shown schematically as two branch supply lines) connected to an "upstream" side of an evaporator 252 of the cooling system 250 and routed to modular cooling elements 20, and includes a branch return header 238 and branch return lines 236 (shown schematically as two branch return lines) interconnecting the modular cooling elements 20 and a "downstream" side of evaporator 252. The branch supply header 232 includes a control valve 240 (such as a liquid solenoid valve, on-off device, etc.) and an expansion device 242 (such as an electronic or thermostatic expansion valve, etc.) for providing the refrigerant to the modular cooling elements 20. Each branch supply line 234 also includes a control valve 244 and an expansion device 246 for providing the refrigerant to each modular cooling element 20. A control valve 248 (such as a solenoid valve, pressure regulating valve, etc.) is provided on each branch return line 236 to control, balance or regulate the flow of refrigerant through each modular cooling element 20 and a control valve 249 (such as a solenoid valve, pressure regulating valve, etc.) is provided on the branch return header 238 to control, balance or regulate the flow of the refrigerant from the piping system 230. According to an alternative embodiment, any suitable number of branch supply and return lines may be provided to circulate fluid to any number of modular cooling elements provided within the case, or to accommodate the addition of other modular cooling elements at a future time (e.g. when product types or loading conditions within the case are changed or modified, etc.).

Figure 7:
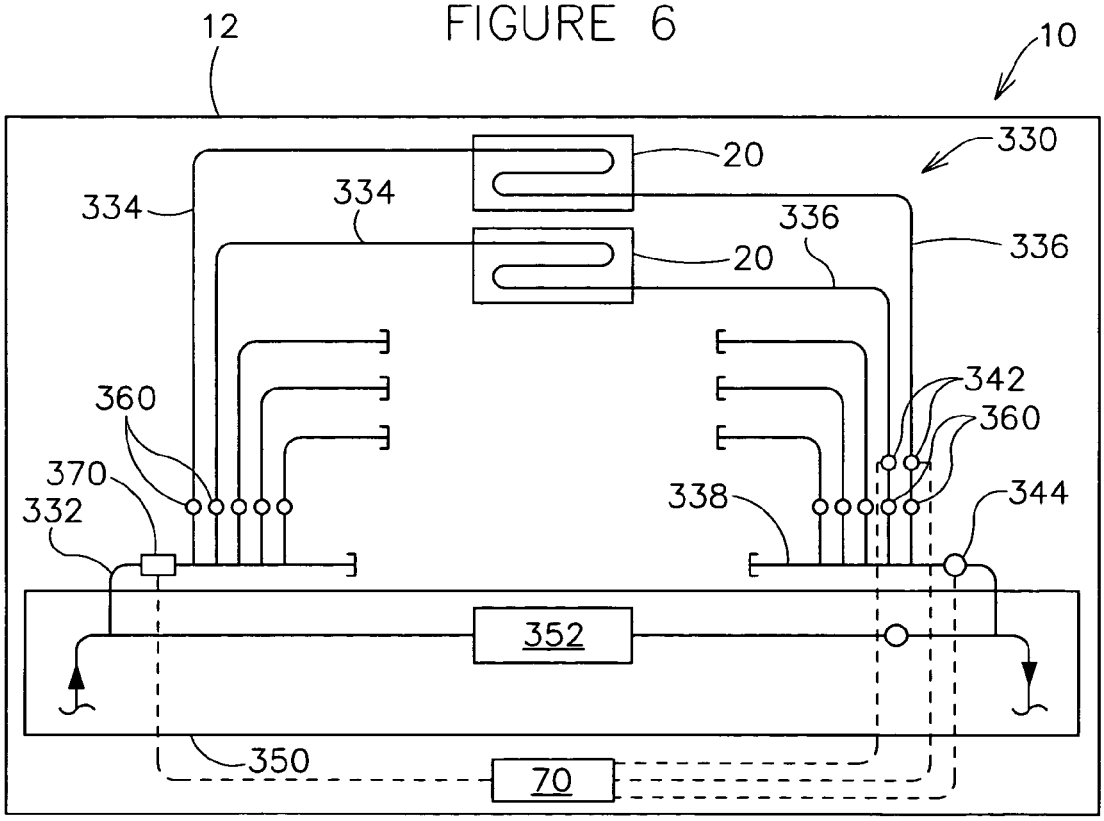
FIG. 7 is a schematic diagram of a piping system for a modular refrigeration system according to a further exemplary embodiment.

Referring to FIG. 7, a piping system 330 for use with independent control of modular cooling elements 20 (shown schematically as two modular cooling elements) and a liquid secondary coolant type cooling system 350 for a case is shown according to an exemplary embodiment. Piping system 330 includes a branch supply header 332 and branch supply lines 334 (shown schematically as two branch supply lines) connected to an "upstream" side of a main heat exchanger 352 of the cooling system 350 and routed to modular cooling elements 20, and a branch return header 338 and branch return lines 336 (shown schematically as two branch return lines) interconnecting the modular cooling elements 20 and a "downstream" side of the main heat exchanger 352. The branch supply lines 334 and branch return lines 336 include connection devices 360 (e.g. quick disconnects, etc.) for coupling the branch supply and return lines to the branch supply and return headers. A control valve 342 (such as a solenoid valve, flow regulating valve, etc.) is provided on each branch return line 336 to control the flow of secondary coolant through each modular cooling element 20 and a control valve 344 (such as a solenoid valve, flow regulating valve, etc.) is provided on the branch return header 338 to control, balance or regulate the flow of the secondary coolant from the piping system 330 to the cooling system 350. According to an alternative embodiment, any suitable number of branch supply and return lines may be provided to circulate secondary coolant to any number of modular cooling elements provided within the case, or to accommodate the addition of other modular cooling elements at a future time (e.g. when product types or loading conditions within the case are changed or modified, etc.).

Referring further to FIG. 7, the piping system may also include a fluid moving device (shown schematically, for example, as a pump 370, etc.) according to an exemplary embodiment. Pump 370 may be provided at any suitable location within the cooling system or piping system (shown schematically as located on branch supply header 332) and is intended to provide for additional pressure and/or flow of the secondary coolant. Pump 370 may be provided to obtain a desired flow rate of secondary coolant throughout a piping system interconnecting a single modular cooling element, or a "network" of multiple modular cooling elements. According to any exemplary embodiment, the pump is located and sized to provide a the desired flow rate of secondary coolant required to achieve a desired cooling rate at the modular cooling element(s) and to address certain factors such as pressure drop associated with the piping system and the modular cooling elements.

Figure 8:
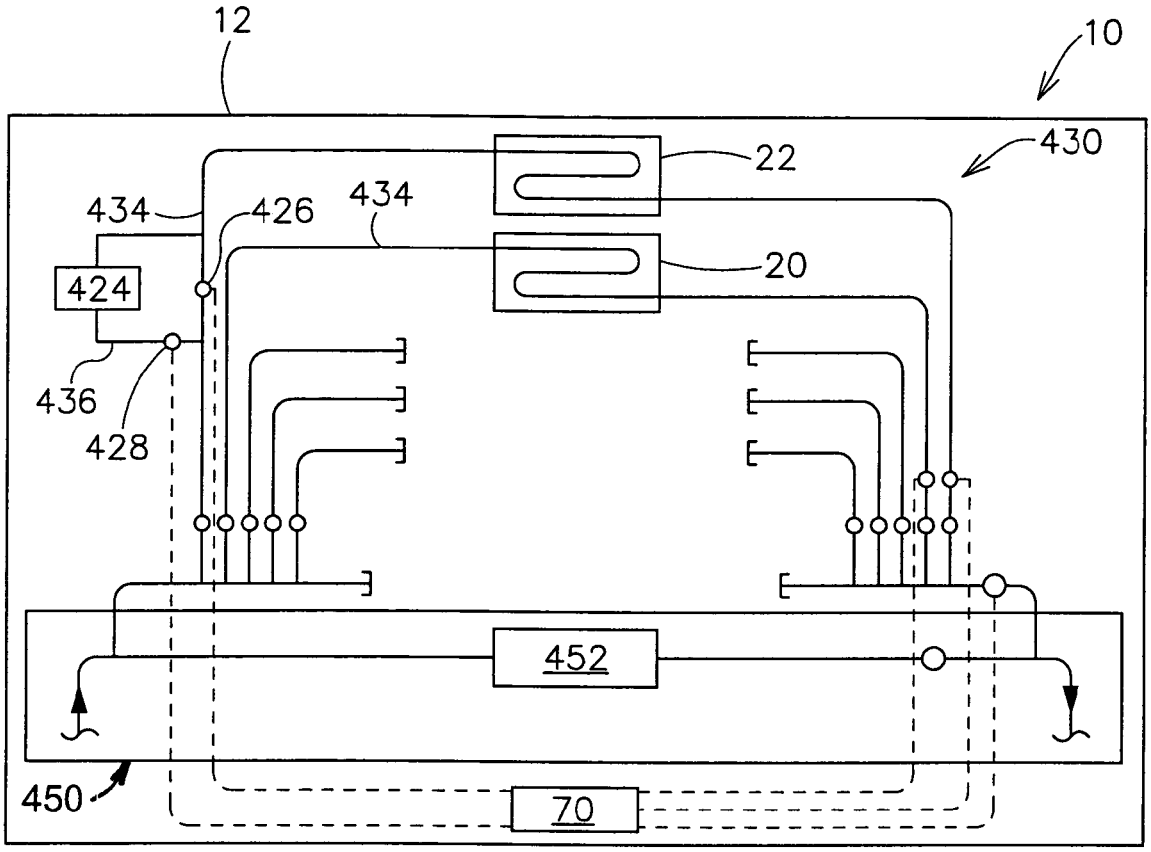
FIG. 8 is a schematic diagram of a piping system for a modular refrigeration system according to a further exemplary embodiment.

Referring to FIG. 8, the modular cooling elements of the modular refrigeration system may be reconfigured to provide warming to certain locations in a refrigeration device. For example, the piping system and one or more modular cooling elements (operating as "modular warming elements" 22) may be configured to provide warming to certain areas within case 12, such as locations where cooling influences produce "cold spots" that may not be sufficiently resolved by "floating" or raising the overall operating temperature of the case. A modular warming element 22 may be located at such cold spots and the flow of secondary coolant is shown schematically to be diverted or routed by the piping system 430 (e.g. a branch supply line 434, etc.) through a warming source 424 to warm the secondary coolant for circulation through the warming element 22. The warming source may be any suitable heat exchanger configured to transfer heat to the secondary coolant from any available source (e.g. "hot" refrigerant gas, ambient air within the facility, etc.) The piping system 430 is shown including a warming line 436 configured to direct secondary coolant from branch supply line 434 through warming source 424 to the modular warming element 22. One or more valves (shown as valves 426 and 428) are configured to direct the secondary coolant to the warming source when warming is desired at the modular warming element, and to bypass the warming source when warming at the modular warming source is not desired. According to any exemplary embodiment, any one or more modular warming elements may be used in combination with any one or more modular cooling elements in the case to customize a temperature profile within the case.

According to any exemplary embodiment, a control system 70 is provided to control the operation of the refrigeration system and to control and/or regulate the flow of coolant to the modular cooling elements 20. The control system 70 may include temperature sensors positioned within the case (e.g. at end or side panels, at upper and lower locations, along shelves or other components, or adjacent to products to provide a signal representative of a temperature at a particular location within the case and to operate the appropriate coolant regulating devices (e.g. control valves, expansion devices, etc.) to initiate, terminate or otherwise regulate the flow of coolant to the modular control element(s). The control system 70 may include a microprocessor or other suitable device having a pre-established or adaptable control scheme for monitoring signals representative of temperature provided by the temperature sensors and initiating actions at appropriate times to control the operation of the modular cooling element(s). The control system may also have other elements (e.g. timers, etc.) for controlling defrost operations of the cooling system and the modular cooling element(s) and for monitoring the consumption of energy by the case. The control system may also be configured to provide indications (e.g. alarms, signals, etc.) when conditions are present in the case that call for attention (e.g. corrective action, maintenance, recalibration, etc.).

According to any preferred embodiment, the modular refrigeration system provides a cooling element that is configured for installation at any suitable location within a refrigeration device such as a temperature controlled case to provide "localized" cooling and to permit "customizing" the thermal performance of the case such as to provide a more uniform temperature distribution profile of products within the case. The modular cooling elements may be provided in any suitable shape, size, and appearance and with any suitable capacity to improve or enhance the thermal performance of "new" cases or of "existing" cases. The modular cooling elements can be selectively installed, removed, relocated or reconfigured within the case to adapt to changes in an operating environment of the case, performance of the case, or to changes or modifications in product type or loading configurations within the case. The modular cooling elements may be mounted or otherwise attached within the case using any suitable connection devices such as fasteners, adhesives, magnetic attraction, hook-and-loop fasteners, brackets, interference fit, clips, etc. The piping system is configured for adaptation with any type of cooling system provided for the case and includes suitable connection devices and coolant flow regulating devices to circulate the coolant to the modular cooling elements. The piping system may comprise any suitable hardware such as piping, tubing, flexible or rigid hoses, quick disconnects or other coupling devices. The control system includes suitable sensors and operating hardware and/or software to operate and control the case and regulate a flow of coolant to the modular cooling elements, so that a desired (e.g. more uniform, etc.) temperature distribution profile can be established within the case.

According to other alternative embodiments, the modular refrigeration system may be configured for use with a refrigerator, a freezer, a cold storage room, walk-in freezer, etc. In further alternative embodiments, the modular refrigeration system may used with an open storage or display device such as "reach-in" type coolers that may have a fan or other device for creating an "air curtain" of cooled air that creates a boundary between warmer ambient air and the cooled space in which the products are stored and/or displayed. According to other exemplary embodiments, the flow regulating devices (e.g. valves, etc.) and/or manifolds or headers (e.g. providing a coolant supply to the cooling elements) for the system may be installed within a case (e.g. structure) or may be external to the case.

It is important to note that the construction and arrangement of the elements of the modular refrigeration system provided herein are illustrative only. Although only a few exemplary embodiments of the present inventions have been described in detail in this disclosure, those skilled in the art who review this disclosure will readily appreciate that many modifications are possible in these embodiments (such as variations in features such as components, formulations of coolant compositions, heat sources, orientation and configuration of the modular cooling elements, piping system components, capacities and locations of the modular cooling elements, the location of components and sensors of the cooling system and control system; variations in sizes, structures, shapes, dimensions and proportions of the components of the system, use of materials, colors, combinations of shapes, etc.) without materially departing from the novel teachings and advantages of the inventions. For example, closed or open space refrigeration devices may be used having either horizontal or vertical access openings, and the modular cooling elements may be provided in any number, size, shape, orientation and arrangement to suit a particular refrigeration system. Locations for the modular cooling elements may be determined empirically or predetermined based on operating assumptions relating to the intended use or application of the refrigeration device. According to other alternative embodiments, the modular refrigeration system may be used with any device using a refrigerant or a liquid coolant, or a combination of a refrigerant and a liquid coolant, for transferring heat from one space to be cooled to another space or source designed to receive the rejected heat and may include commercial, institutional or residential refrigeration systems. Further, it is readily apparent that variations of the modular refrigeration system and its components and elements may be provided in a wide variety of types, shapes, sizes and performance characteristics, or provided in various locations within the case or refrigeration device. Accordingly, all such modifications are intended to be within the scope of the inventions.

The order or sequence of any process or method steps may be varied or resequenced according to alternative embodiments. In the claims, any-means-plus-function clause is intended to cover the structures described herein as performing the recited function and not only structural equivalents but also equivalent structures. Other substitutions, modifications, changes and omissions may be made in the design, operating configuration and arrangement of the preferred and other exemplary embodiments without departing from the spirit of the inventions as expressed in the appended claims.

What is claimed is:

1. A modular refrigeration system, comprising:

refrigeration device having a space configured for storage of products therein;

a cooling system providing a coolant to a primaiy cooling element configured to provide cooling generally throughout the space;

at least one supplemental portable cooling element configured for placement at a first location and movable to a second location and configured to receive the coolant to provide supplemental cooling to the space.

2. The modular refrigeration system of claim 1 wherein the refrigeration device is a temperature controlled case.

3. The modular refrigeration system of claim 1 wherein the coolant is a liquid coolant.

4. The modular refrigeration system of claim 1 wherein the coolant is a direct expansion refrigerant.

5. The modular refrigeration system of claim 1 wherein the refrigeration device comprises a main heat exchanger and the portable cooling element is configured to provide supplemental cooling at any one of a plurality of predetermined locations within the space.

6. The modular refrigeration system of claim 1 further comprising a piping system interfacing with the cooling system and the portable cooling element and configured to circulate the coolant through the portable cooling element.

7. The modular refrigeration system of claim 6 further comprising quick disconnects coupled to the piping system to permit installation and removal of the portable cooling element.

8. The modular refrigeration system of claim 1 wherein the portable cooling element is configured for interchangeable installation at one a plurality of locations within the space.

9. The modular refrigeration system of claim 1 wherein the portable cooling element is coupled to a shelf.

10. The modular refrigeration system of claim 1 wherein the portable cooling element is coupled to an end panel.

11. The modular refrigeration system of claim 1 further comprising a control system configured to regulate a flow of the coolant to the portable cooling element.

12. A system for customizing a temperature distribution profile within a space of a temperature controlled case for storage and display of food products, comprising:

a cooling system having a first heat exchanger in a substantially fixed location and a coolant configured to cool the space;

a second heat exchanger configured for movable placement at any one of a plurality of desired locations to provide cooling to the space;

a piping system configured to interface with the cooling system and the second heat exchanger to provide a supply of coolant to the second heat exchanger; and a control system configured to regulate a flow of coolant through the second heat exchanger.

13. The system of claim 12 wherein the temperature controlled case is an existing temperature controlled case and the second heat exchanger is configured for placement as a retrofit application.

14. The system of claim 12 wherein the temperature controlled case is a new temperature controlled case and the second heat exchanger is configured for placement during construction of the new temperature controlled case.

15. The system of claim 12 wherein the first heat exchanger is a main heat exchanger and the second heat exchanger is a modular cooling element.

16. The system of claim 15 wherein the modular cooling element is removably coupled to a surface within the space.

17. The system of claim 15 wherein the modular cooling element is configured for placement at a predetermined location within the space to provide a source of supplemental cooling.

18. The system of claim 17 wherein the predetermined location is a shelf unit.

19. The system of claim 17 wherein the predetermined location is an end panel.

20. The system of claim 15 wherein the piping system includes at least one flow control device configured to regulate a flow of coolant to the modular cooling element.

21. The system of claim 15 wherein the modular cooling element is a fin-coil type heat exchanger.

22. The system of claim 12 wherein the piping system further comprises at least one quick disconnect device configured to interconnect the piping system and the second heat exchanger.

23. A temperature controlled case having a modular cooling system, comprising:

a cooling system providing, a coolant and having a main cooling element in a substantially fixed location and configured to receive the coolant and provide cooling to a space within the temperature controlled case;

at least one supplemental cooling element configured to interface with the cooling system and to receive a supply of the coolant;

wherein the supplemental cooling element is configured to be movably mounted at any one of a plurality of locations to provide supplemental cooling within the space.

24. The temperature controlled case of claim 23 wherein the supplemental cooling element is configured to mount on a shelf unit.

25. The temperature controlled case of claim 23 wherein the supplemental cooling element is configured to mount on a panel member.

26. The temperature controlled case of claim 23 wherein the coolant is one of a liquid secondary coolant and a direct expansion refrigerant.

27. The temperature controlled case of claim 23 wherein the supplemental cooling element is configured for interchangeable installation at a predetermined location.

28. The temperature controlled case of claim 23 wherein the supplemental cooling element is configured to provide a localized source of cooling within the space.

29. The temperature controlled case of claim 23 wherein the supplemental cooling element is configured as a substantially flat panel.

30. The temperature controlled case of claim 23 wherein the supplemental cooling element has a cooling capacity sufficient to minimize a temperature variation within the space.

31. The temperature controlled case of claim 23 wherein the supplemental cooling element is reconfigurable to accommodate changes to the temperature, controlled case.

32. The temperature controlled case of claim 23 further comprising a supplemental warming element configured to receive a warmed supply of the coolant.

33. A method of customizing a temperature distribution profile within a refrigeration device having a cooling system, comprising:

determining a temperature distribution profile within the refrigeration device provided by the cooling system;

identifying at least one location within the refrigeration device having a temperature above a desired temperature range;

providing a portable cooling element configured for installation at the location; and interconnecting the portable cooling element with the cooling system.

34. The method of claim 33 wherein the step of determining a temperature distribution profile comprises experimentation.

35. The method of claim 33 wherein the portable cooling element is configured to provide localized cooling at the location.

36. The method of claim 33 wherein the step of interconnecting the portable cooling element with the cooling system comprises providing a piping system having at least one connection device.

37. The method of claim 36 wherein the piping system further comprises at least one flow control device.

38. The method of claim 33 wherein the portable cooling element is configured for interchangeable installation at one or more locations.

39. The method of claim 33 wherein the refrigeration device is a temperature controlled case.

40. The method of claim 33 wherein the temperature controlled case is a new construction temperature controlled case.

41. The method of claim 33 wherein the step of determining a temperature distribution profile comprises monitoring a temperature of a plurality of predetermined products intended for storage and display within the refrigeration device.

* * * * *

UNITED STATES PATENT AND TRADEMARK OFFICE

CERTIFICATE OF CORRECTION

PATENT NO. : 7,159,413 B2
APPLICATION NO. : 10/689785
DATED : January 9, 2007
INVENTOR(S) : William K. Dail It is certified that error appears in the above-identified patent and that said Letters Patent is hereby corrected as shown below:

Col. 11, line 13, claim 1, before “refrigeration” please insert --a--.

Col. 11, line 15, please replace “primai” with --primary--.

Col. 12, line 34, claim 23, please delete “,” after --providing--.

Col. 13, line 3, claim 31, please delete “,” after --temperature--.

Signed and Sealed this

Twenty-third Day of October, 2007

JON W. DUDAS
*Director of the United States Patent and Trademark Office*